US011011111B2

(12) United States Patent
Ichikura et al.

(10) Patent No.: US 11,011,111 B2
(45) **Date of Patent: *May 18, 2021**

(54) DISPLAY DRIVING DEVICE

(71) Applicant: LAPIS Semiconductor Co., Ltd., Yokohama (JP)

(72) Inventors: Hiroyoshi Ichikura, Yokohama (JP); Hiroki Aizawa, Yokohama (JP); Takeshi Nosaka, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/788,687

(22) Filed: Feb. 12, 2020

(65) Prior Publication Data

US 2020/0184891 A1 Jun. 11, 2020

Related U.S. Application Data

(63) Continuation of application No. 15/962,861, filed on Apr. 25, 2018, now Pat. No. 10,580,357.

(30) Foreign Application Priority Data

Jan. 30, 2018 (JP) ..... JP2018-013271

(51) Int. Cl.
*G09G 3/3233* (2016.01)
*G05F 3/08* (2006.01)

(52) U.S. Cl.
CPC ..... *G09G 3/3233* (2013.01); *G05F 3/08* (2013.01); *G09G 2310/0289* (2013.01); *G09G 2330/023* (2013.01)

(58) Field of Classification Search
CPC ..... G09G 3/3406; G09G 3/3688; G09G 2330/02; H05B 33/0815; H05B 33/0827
See application file for complete search history.

(56) References Cited

U.S. PATENT DOCUMENTS

| | | | | |
|---|---|---|---|---|
| 8,704,818 | B2 | 4/2014 | Ess et al. | |
| 9,584,122 | B1 | 2/2017 | McCombs | |
| 2008/0284719 | A1* | 11/2008 | Yoshida | G02F 1/136209 345/102 |
| 2015/0325200 | A1 | 11/2015 | Rho et al. | |

FOREIGN PATENT DOCUMENTS

| | | | |
|---|---|---|---|
| JP | 2007-122156 | A | 5/2007 |
| WO | 2012/081222 | A1 | 6/2012 |

* cited by examiner

*Primary Examiner* — Nelson M Rosario
(74) *Attorney, Agent, or Firm* — Rabin & Berdo, P.C.

(57) ABSTRACT

A display driving device comprising: a high supply voltage operation unit that generates an operating current under application of a high supply voltage so as to supply driving voltages to a display panel; a low supply voltage operation unit that operates under the application of a low supply voltage lower than the high supply voltage and controls the high supply voltage operation unit; and a reuse circuit that receives the operating current from the high supply voltage operation unit and supplies the operating current to a ground side via the low supply voltage operation unit so as to apply the low supply voltage to the low supply voltage operation unit.

4 Claims, 6 Drawing Sheets

DISPLAY DRIVING DEVICE

CROSS-REFERENCE TO RELATED APPLICATIONS

This is a continuation of co-pending U.S. application Ser. No. 15/962,861, filed on Apr. 25, 2018, which is based upon and claims the benefit of priority from Japanese Patent Application No. 2018-013271, filed on Jan. 30, 2018. The entire disclosures of these prior U.S. and foreign applications are incorporated herein by reference.

BACKGROUND OF THE INVENTION

1. Field of the Invention

The present invention relates to a display driving device to which a plurality of supply voltages having voltage levels different from one another are applied for its operation.

2. Description of the Related Art

In general, the operating voltages of semiconductor devices have been decreased, for example, to 1.2 V as a result of their miniaturized internal circuits. This has achieved reduction in their power consumptions. Since the circuit part of a display driving device is also configured as a semiconductor device, a logic circuit such as a control circuit operates at a low voltage. An output stage including output circuits each configured to output a driving voltage to a display panel, on the other hand, requires a high operating voltage such as 7 V in order to generate driving voltages corresponding to luminance levels of pixels, respectively, for example. A preceding stage circuit such as an input interface unit for a video signal operates at a medium operating voltage such as 1.8 V, for example. Since the entire display driving device cannot operate at a single low voltage as just described, reduction in power consumption has not progressed much. In display driving devices used in mobile devices such as recent smartphones, however, reduction in power consumption, among others, has been demanded to obtain high-definition display and to avoid frequent charging of batteries, which are main power supplies.

As a conventional technique, Japanese Patent Kokai No. 2007-122156 discloses a voltage regulator that can generate one or more desired voltages from a high voltage. In addition to a first regulator circuit that generates a first supply voltage by stepping down an external supply voltage, the voltage regulator includes a second regulator circuit and a third regulator circuit. The second regulator circuit and the third regulator circuit each operate using the first supply voltage as a power supply and each step down the external supply voltage using an element for stepping down a voltage. The second regulator circuit and the third regulator circuit can generate a second supply voltage and a third supply voltage, respectively, using a voltage controlling driver elements each of which uses the stepped-down voltage as an input voltage, and can output the generated second and third supply voltages to respective loads.

In such a conventional display driving device, however, reduction in supply voltage or operating current for the purpose of achieving reduced power consumption may fail to obtain desired characteristics, require changes in operating conditions, or, in some cases, increase the manufacturing cost of the device when a circuit change is made in order to obtain desired characteristics. Thus, it has been difficult to reduce power consumption easily.

SUMMARY OF THE INVENTION

In view of the aforementioned circumstances, it is an object of the present invention to provide a display driving device that can reduce its power consumption relatively easily and effectively.

According to one aspect of the present invention, a display driving device configured to drive a display panel comprises: a high supply voltage operation unit configured to generate an operating current under application of a high supply voltage so as to supply driving voltages to the display panel; a low supply voltage operation unit configured to operate under application of a low supply voltage lower than the high supply voltage thereby to control the high supply voltage operation unit; and a reuse circuit configured to receive the operating current from the high supply voltage operation unit and supply the operating current to a ground side via the low supply voltage operation unit so as to apply the low supply voltage to the low supply voltage operation unit.

According to the display driving device of the present invention, the operating current flowing through the high supply voltage operation unit is supplied to the ground side by the reuse circuit via the low supply voltage operation unit. This causes the low supply voltage to be applied to the low supply voltage operation unit and thereby achieves the effective utilization of the operating current of the high supply voltage operation unit. Thus, the power consumption of the display driving device can be reduced.

DETAILED DESCRIPTION OF THE INVENTION

Figure 1:
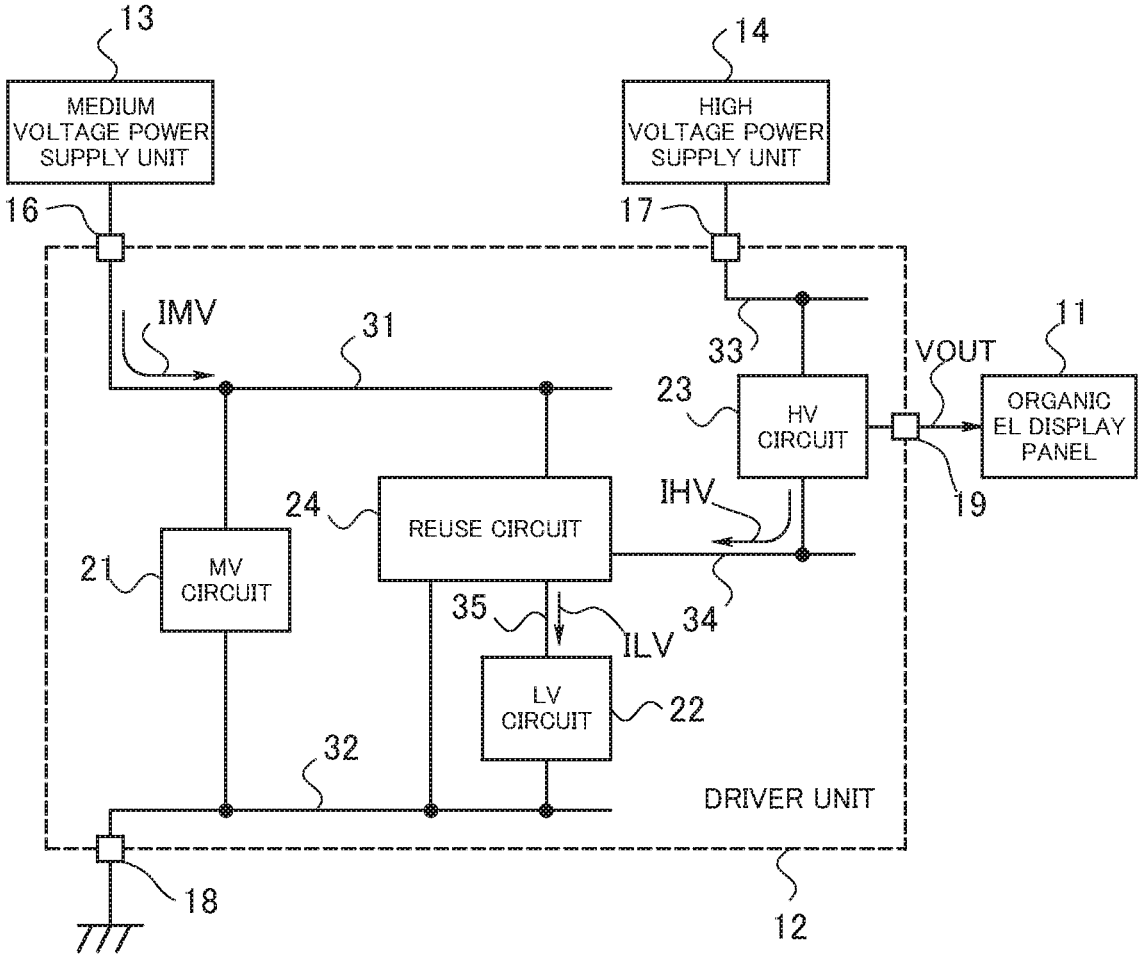
FIG. 1 is a block diagram illustrating the configuration of a device for driving an organic EL display according to a first embodiment of the present invention.

Embodiments of the present invention will now be described below in detail with reference to the drawings. FIG. 1 illustrates the configuration of a display driving device according to a first embodiment of the present invention. Note that FIG. 1 illustrates power supply lines and drive output lines and omits control lines and signal supply lines between circuits.

The driving device includes a driver unit 12 that drives an organic EL display panel 11, and two power supply units 13 and 14 that provide supply voltages to the driver unit 12.

The organic EL display panel 11 is configured, for example, by arranging a plurality of organic EL elements in a matrix shape as pixels. The power supply unit 13 generates a medium voltage MV (medium supply voltage) as a supply voltage. The power supply unit 14 generates a high voltage HV (high supply voltage) that is higher than the medium voltage MV.

The driver unit 12 includes: an MV circuit 21 to which the medium voltage MV is applied as a supply voltage; an LV circuit 22 (low supply voltage operation unit) to which a low voltage LV (low supply voltage) that is lower than the medium voltage MV is applied; an HV circuit 23 (high supply voltage operation unit) to which the high voltage HV is applied as a supply voltage; and a reuse circuit 24 to supply the low voltage LV to the LV circuit 22. The HV circuit 23 corresponds to an output stage of the driver unit 12 and outputs driving voltages VOUT to the organic EL display panel 11. The MV circuit 21 is, for example, a unit that receives an input image signal and generates, according to the input image signal, luminance data of pixels for each display line in the organic EL display panel 11. The LV circuit 22 is a control circuit, which is a logic circuit, functioning as a stage preceding the output stage of the driver unit 12. The LV circuit 22 controls the MV circuit 21 and the HV circuit 23 on the basis of a synchronization signal of the input image signal.

The high voltage HV, the medium voltage MV, and the low voltage LV are all positive voltages, and satisfy the relationship of HV>MV>LV as mentioned above. In the present embodiment, HV=7 [V], MV=1.8 [V], and LV=1.2 [V].

Figure 2:
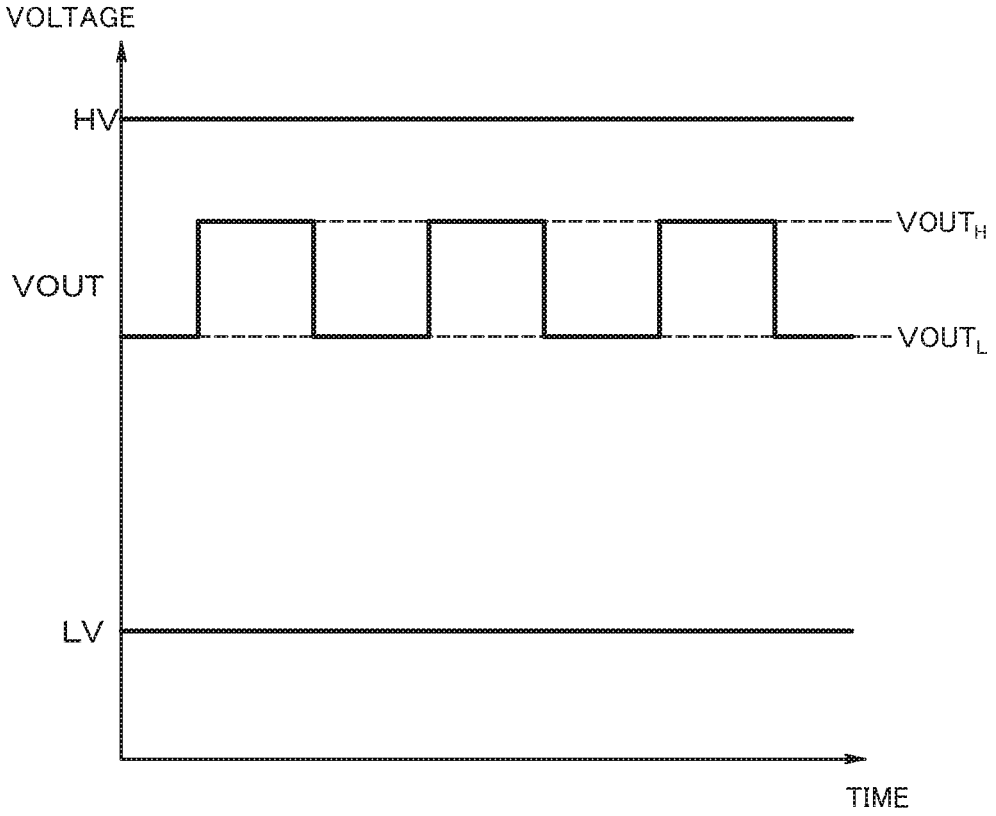
FIG. 2 is a chart showing the range of a driving voltage of the device illustrated in FIG. 1.

Each of the driving voltages VOUT, which the HV circuit 23 outputs to the organic EL display panel 11, is what is called a source driver output. As shown in FIG. 2, each of the driving voltages VOUT has a range of a voltage $VOUT_L$ (for example, 3 [V] or more) that is sufficiently higher than the low voltage LV to a voltage $VOUT_H$ (for example, 5 [V] or less) that is lower than the high voltage HV.

A voltage application line 31 and a ground line 32 are individually connected to each of the MV circuit 21 and the reuse circuit 24. The voltage application line 31 is an application line of the medium voltage MV that is connected to an output terminal of the power supply unit 13. The ground line 32 is a grounding line the same as the ground line of the power supply units 13 and 14. A current IMV obtained by the medium voltage MV, which is supplied via the voltage application line 31, flows into the MV circuit 21 and the reuse circuit 24 as an operating current. The current IMV then flows from the circuits to the ground line 32.

A voltage application line 33 and a relay connection line 34 are connected to the HV circuit 23. The voltage application line 33 is an application line of the high voltage HV that is connected to an output terminal of the power supply unit 14. The relay connection line 34 also functions as a ground line dedicated for the HV circuit 23. A current IHV obtained by the high voltage HV, which is supplied via the voltage application line 33, flows into the HV circuit 23 as an operating current. The current IHV then flows from the HV circuit 23 to the relay connection line 34.

The relay connection line 34 is connected to the reuse circuit 24. The reuse circuit 24 is connected to a voltage application line 35 (second voltage application line) to output the low voltage LV to the voltage application line 35.

The voltage application line 35 and the ground line 32 are connected to the LV circuit 22. A current ILV obtained by the low voltage LV, which is supplied by the reuse circuit 24 via the voltage application line 35, flows into the LV circuit 22 as an operating current. The current ILV then flows from the LV circuit 22 to the ground line 32.

As illustrated in FIG. 1, the driver unit 12 includes external connection terminals 16 to 19. The driver unit 12 connects to the organic EL display panel 11, the power supply units 13 and 14, and an external ground via the external connection terminals 16 to 19.

Figure 3:
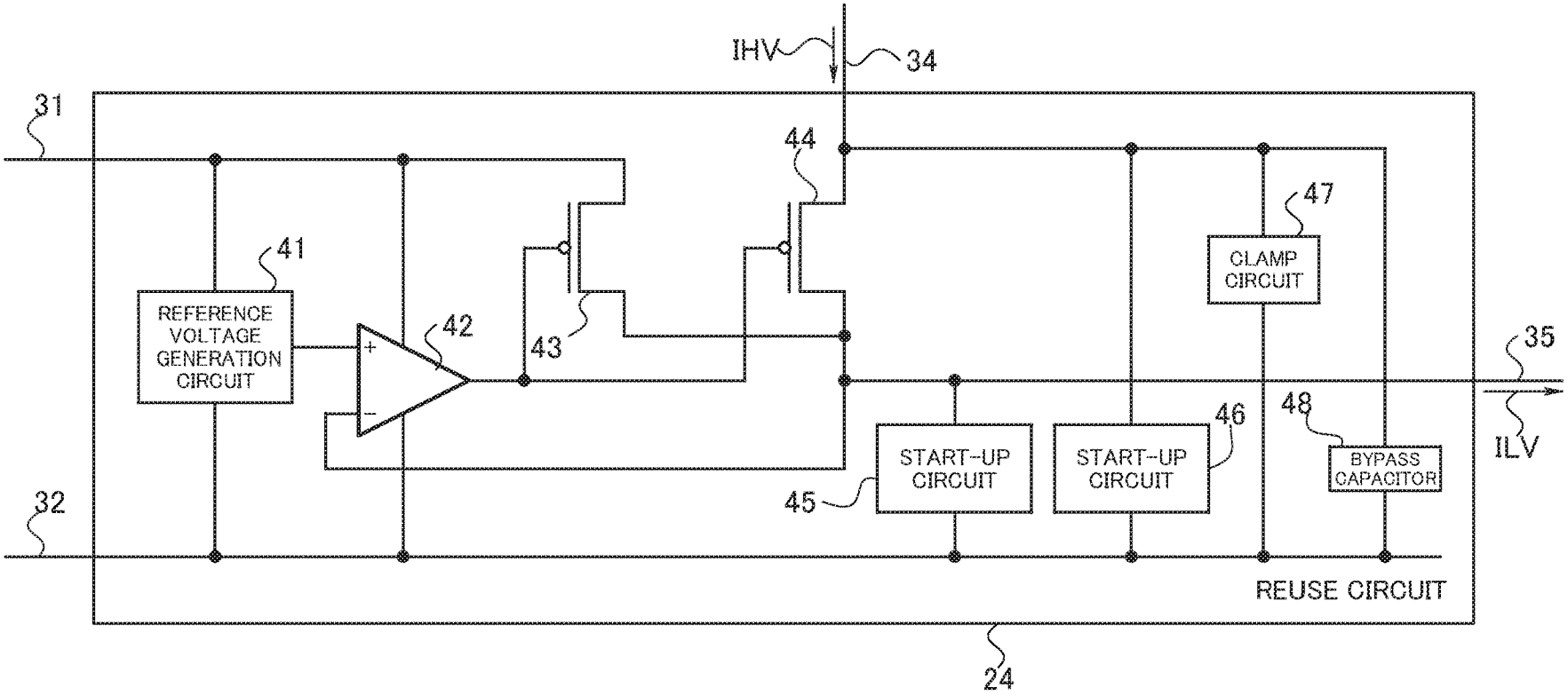
FIG. 3 is a circuit diagram illustrating a specific configuration of a reuse circuit in the device of FIG. 1.

As specifically illustrated in FIG. 3, the reuse circuit 24 includes: a reference voltage generation circuit 41; an operational amplifier 42; field-effect transistors (PMOS and FET) 43 and 44, which serve as switching elements; start-up circuits 45 and 46; a clamp circuit 47; and a bypass capacitor 48.

The voltage application line 31 (first voltage application line) and the ground line 32 are individually connected to each of the reference voltage generation circuit 41 and the operational amplifier 42. The medium voltage MV is applied to the reference voltage generation circuit 41 and the operational amplifier 42 as a supply voltage. The reference voltage generation circuit 41 is a reference voltage generation unit that generates the low voltage LV as a reference voltage on the basis of the medium voltage MV. In order to obtain the low voltage LV from the medium voltage MV, the reference voltage generation circuit 41 includes, for example, a simple constant voltage circuit having a Zener diode and a resistor or a voltage-dividing circuit having two resistors connected in series, and a voltage follower.

The voltage follower of the reference voltage generation circuit 41 uses the low voltage LV supplied by the constant voltage circuit or the voltage-dividing circuit as an input voltage, and outputs the low voltage LV at a low impedance.

The operational amplifier 42 is a switch driving unit that drives each of the field-effect transistors 43 and 44 on and off. A positive input terminal of the operational amplifier 42 is connected to an output terminal of the reference voltage generation circuit 41. A negative input terminal of the operational amplifier 42 is connected to drains of the field-effect transistors 43 and 44. An output terminal of the operational amplifier 42 is connected to gates of the field-effect transistors 43 and 44. A source of the field-effect transistor 43, which is a first switching element, is connected to the voltage application line 31. A source of the field-effect transistor 44, which is a second switching element, is connected to the relay connection line 34. The drains of the field-effect transistors 43 and 44 are connected to the voltage application line 35.

The start-up circuit 45 is connected to the voltage application line 35 and the ground line 32. When the power is turned on, the start-up circuit 45 temporarily applies a start-up voltage SV1 that is approximately equal to the low voltage LV to the voltage application line 35. Although not shown in the figure, the start-up circuit 45 is connected to the voltage application line 31 and generates the start-up voltage SV1 on the basis of the medium voltage MV, for example. The start-up voltage SV1 is generated only during a period from the power activation to a time when the operation of the LV circuit 22 becomes stabilized.

The start-up circuit 46 is connected to the relay connection line 34 and the ground line 32. When the power is turned on, the start-up circuit 46 temporarily applies a start-up voltage SV2 (for example, 2.0 to 2.5 [V]) that is slightly higher than the medium voltage MV to the relay connection line 34. Although not shown in the figure, the start-up circuit 46 is connected to the voltage application line 33 and steps down the high voltage HV to generate the start-up voltage SV2, for example. The start-up voltage SV2 is generated only during a period from the power activation to a time when the operation of the HV circuit 23 becomes stabilized.

The clamp circuit 47 is provided between the relay connection line 34 and the ground line 32 to prevent the voltage of the relay connection line 34 from excessively rising to 3 [V] or more, for example. The bypass capacitor 48 is a capacitor provided between the relay connection line 34 and the ground line 32 to prevent ripple in the voltage of the relay connection line 34.

In the driving device having such a configuration, once the power supply units 13 and 14 start operating to provide supply voltages, the start-up circuits 45 and 46 first start operating immediately. This raises the voltage level of the voltage application line 35 to the start-up voltage SV1 and the voltage level of the relay connection line 34 to the start-up voltage SV2.

The reference voltage generation circuit 41 generates a reference voltage, which is the low voltage LV. The reference voltage is supplied to the positive input terminal of the operational amplifier 42. The operational amplifier 42 compares the reference voltage to the voltage of the negative input terminal. The operational amplifier 42 and the field-effect transistor 43 operate as one voltage regulator. More specifically, in the field-effect transistor 43, a current flows from the voltage application line 31 into the voltage application line 35 via the source-drain of the field-effect transistor 43 so as to equalize the voltage of the positive input terminal and the voltage of the negative input terminal. This stabilizes the voltage of the voltage application line 35 at the low voltage LV and the stabilized voltage is applied to the LV circuit 22.

On the other hand, the high voltage HV, which is the output voltage of the power supply unit 14, is applied to the HV circuit 23 via the voltage application line 33 to operate the HV circuit 23. The operating current IHV of the HV circuit 23 flows into the reuse circuit 24 via the relay connection line 34. The operating current IHV further flows to the voltage application line 35 via the source-drain of the field-effect transistor 44. The voltage of the voltage application line 35 is stabilized at the low voltage LV, and the stabilized voltage is applied to the LV circuit 22. Thus, a resultant current of part of the current IMV and the current IHV flows through the LV circuit 22 as the current ILV.

The field-effect transistor 44 turns on and off together with the field-effect transistor 43 according to the output voltage of the operational amplifier 42. Thus, the flow of the operating current IHV of the HV circuit 23 into the voltage application line 35 is controlled by the source-drain of the field-effect transistor 44 so as to stabilize the voltage of the voltage application line 35 at the low voltage LV. A voltage Vds between the source and drain of the field-effect transistor 44 is determined by the current flowing through the source-drain of the field-effect transistor 44 and the gate potential of the field-effect transistor 44. Thus, by the voltage, the potential of the relay connection line 34 is also determined.

When the current IHV varies by the operation of the HV circuit 23, the voltage of the relay connection line 34 also varies. The clamp circuit 47 suppresses such variation in the voltage of the relay connection line 34. The bypass capacitor 48 prevents the ripple voltage of the relay connection line 34.

Depending on the balance between the current IHV and the current ILV, the currents may flow in both directions between the voltage application line 31 and the relay connection line 34 via the field-effect transistors 43 and 44. The size ratio between the field-effect transistors 43 and 44 is determined so as to prevent such current flow, and the currents flowing through the field-effect transistors 43 and 44 are thus optimized.

A power consumption A of the driving device according to the first embodiment illustrated in FIG. 1 can be calculated as follows.

$$\text{Power consumption } A = \text{medium voltage MV} \times (\text{current IMV} - \text{current IHV}) + (\text{high voltage HV} - \text{low voltage LV}) \times \text{current IHV} \quad (1)$$

Figure 4:
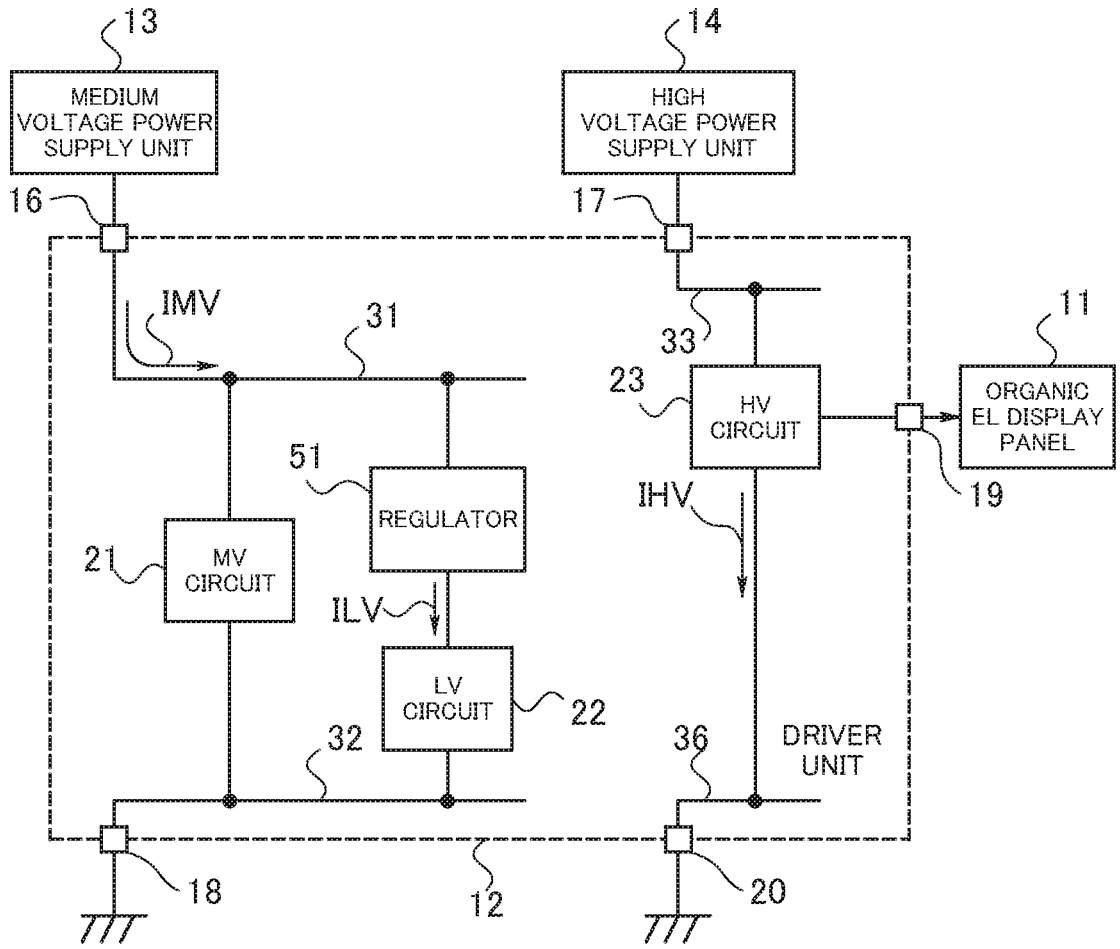
FIG. 4 is a block diagram illustrating an exemplary driving device presented to compare the power consumption thereof to that of the device of FIG. 1.

As a comparison to the power consumption A, FIG. 4 illustrates an example of a driving device using a low voltage stepped down by a regulator as shown in Japanese Patent Kokai No. 2007-122156 mentioned above without employing the reuse circuit 24 included in the first embodiment. The driving device illustrated in FIG. 4 includes a regulator 51 that converts the medium voltage MV, which is the output voltage of the power supply unit 13, to the low voltage LV. The low voltage LV, which is the output voltage of the regulator 51, is applied to the LV circuit 22. The high voltage HV, which is the output voltage of the power supply unit 14, is applied to the HV circuit 23 as it is. The operating current IHV of the HV circuit 23 flows out from the HV circuit 23 via a ground line 36. The ground line 36 is connected to a grounded external connection terminal 20.

A power consumption B of the driving device illustrated in FIG. 4 can be calculated as follows.

$$\text{Power consumption } B = \text{medium voltage MV} \times \text{current IMV} + \text{high voltage HV} \times \text{current IHV} \quad (2)$$

Assuming that the current IMV is 40 [mA] and the current IHV is 35 [mA] as well as HV=7 [V], MV=1.8 [V], and LV=1.2 [V] as mentioned above, the power consumption B=1.8 [V]×40 [mA]+7 [V]×35 [mA]=317 [mW] from Expression (2).

With current consumptions in the circuits being the same, the calculation of the power consumption A according to Expression (1) will be:

Power consumption A=1.8 [V]×(40 [mA]−35 [mA])+(7 [V]− 1.2 [V])×35 [mA]=212 [mW]. The power consumption A of the driving device in the first embodiment illustrated in FIG. 1 is reduced from the power consumption B by approximately 33%. That is, the power consumption can be reduced when the current IHV from the HV circuit 23 is reused in the LV circuit 22. The range of each of the driving voltages VOUT is higher than the low voltage LV. Thus, even when the current IHV from the HV circuit 23 is reused in the LV circuit 22, the driving voltages VOUT can be varied within the desired voltage range of $VOUT_L$ to $VOUT_H$ as shown in FIG. 2.

In the above-described first embodiment, the start-up circuits 45 and 46 are provided so that the voltage of the voltage application line 35 converges to the low voltage LV immediately after the power is turned on. However, if the voltage of the voltage application line 35 that has reached the low voltage LV after some delay since the power activation causes no problems on the operation of the LV circuit 22, there is no need to provide the start-up circuits 45 and 46.

Figure 5:
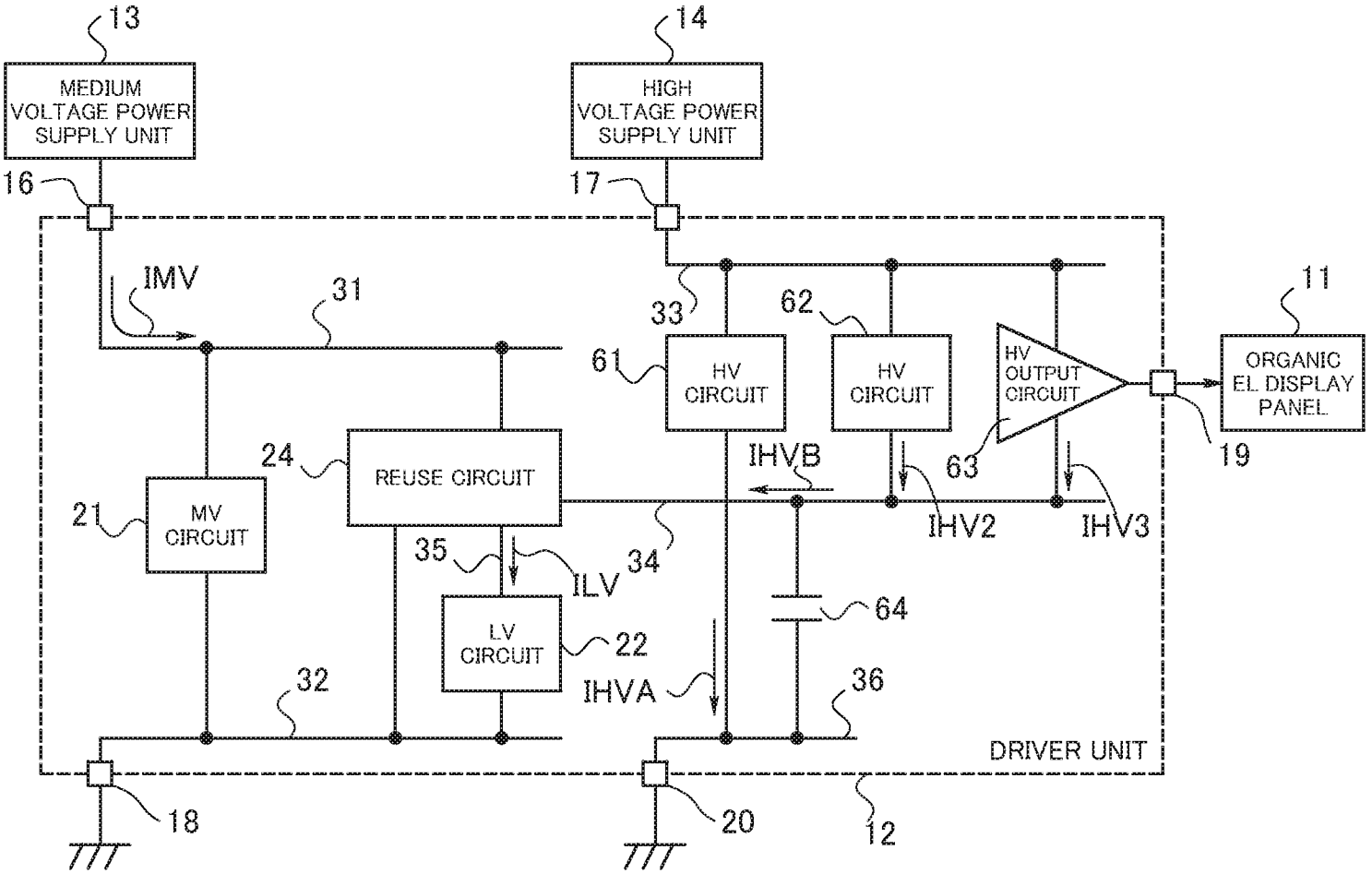
FIG. 5 is a block diagram illustrating the configuration of a device for driving an organic EL display according to a second embodiment of the present invention.

In the above-described first embodiment, the circuit to which the high voltage HV is applied in the driving device is the series circuit of the HV circuit 23 and the LV circuit 22. All of the current IHV flowing through the HV circuit 23 flows through the LV circuit 22. When the HV circuit 23 includes a part that requires a voltage level range from a ground level (for example, 0 [V]) to the high voltage HV, a driving device may be configured in such a way that the HV circuit 23 is divided and part of the current is not reused as illustrated in FIG. 5. Such a driving device will be described below as a second embodiment.

In the second embodiment illustrated in FIG. 5, the HV circuit includes HV circuits 61 and 62 and an HV output circuit 63 in the driver unit 12. The HV circuit 61 is a logic circuit or level shifter for controlling the HV circuit. The HV circuit 61 is a circuit that requires the voltage range from the ground level to the high voltage HV. The voltage application line 33 and the ground line 36 are connected to the HV circuit 61. The ground line 36 may be connected to the ground line 32. A current IHVA obtained by the high voltage HV, which is supplied via the voltage application line 33, flows into the HV circuit 61 as an operating current. The current IHVA then flows from the HV circuit 61 to the ground line 36.

The HV circuit 62 is a bias circuit, for example, and the HV output circuit 63 is an output amplifier circuit, for example. The HV circuit 62 and the HV output circuit 63 operate even when the ground-side potential is larger than or equal to the low voltage LV. The HV circuit 62 and the HV output circuit 63 are circuits in which the application of the positive potential of the high voltage HV is required or desired.

The voltage application line 33 and the relay connection line 34 are individually connected to each of the HV circuit 62 and the HV output circuit 63. A current IHV2 obtained by the high voltage HV, which is supplied via the voltage application line 33, flows into the HV circuit 62 as an operating current. A current IHV3 obtained by the high voltage HV, which is supplied via the voltage application line 33, flows into the HV output circuit 63 as an operating current. The currents IHV2 and IHV3 then flow from the HV circuit 62 and the HV output circuit 63 to the relay connection line 34 as a resultant current IHVB. A bypass capacitor 64 is further connected between the relay connection line 34 and the ground line 36.

The other configuration of the second embodiment illustrated in FIG. 5 is the same as the configuration illustrated in FIG. 1. Once the high voltage HV, which is an output voltage of the power supply unit 14, is applied to the HV circuits 61 and 62 and the HV output circuit 63 via the voltage application line 33, the HV circuits 61 and 62 and the HV output circuit 63 operate. The operating current IHVA of the HV circuit 61 flows to the ground line 36. The operating currents IHV2 and IHV3 of the HV circuit 62 and the HV output circuit 63, on the other hand, flow to the reuse circuit 24 as the current IHVB via the relay connection line 34. The current IHVB further flows to the voltage application line 35 via the source-drain of the field-effect transistor 44 shown in FIG. 3. The voltage of the voltage application line 35 is stabilized at the low voltage LV and the stabilized voltage is applied to an LV circuit 22. Thus, a resultant current of part of a current IMV and the current IHVB flows through the LV circuit 22 as a current ILV. Here, IHVB=IHV−IHVA.

A power consumption C of the driving device according to the second embodiment illustrated in FIG. 5 can be calculated as follows.

Power consumption $C$=medium voltage MV×(current IMV−current IHVB)+high voltage HV×current IHVA+(high voltage HV−low voltage LV)× current IHVB (3)

Assuming that the current IHVA flowing through the HV circuit 61 is 5 [mA], the resultant current IHVB of the currents IHV2 and IHV3 flowing through the HV circuit 62 and the HV output circuit 63 is 30 [mA], and the other voltage values and current values are the same as the values used in the aforementioned calculation of the power consumption A, the calculation of the power consumption C according to Expression (3) will be:

Power consumption C=1.8 [V]×(40 [mA]−30 [mA])+7 [V]×5 [mA]+(7 [V]− 1.2 [V])×30 [mA]=227 [mW]. It can be seen that the power consumption C of the driving device of the second embodiment illustrated in FIG. 5 is reduced from the power consumption B of the exemplary driving device illustrated in FIG. 4 by about 28%. As just described, in the HV circuit 61, the operating current IHVA thereof flows to the ground line 36 so as to obtain a voltage level range from 0 [V] to the high voltage HV. The current IHVB flowing through the HV circuit 62 and the HV output circuit 63 that require no voltage level of 0 [V], on the other hand, is reused in the LV circuit 22. Thus, the power consumption of the driving device can be reduced.

Figure 6:
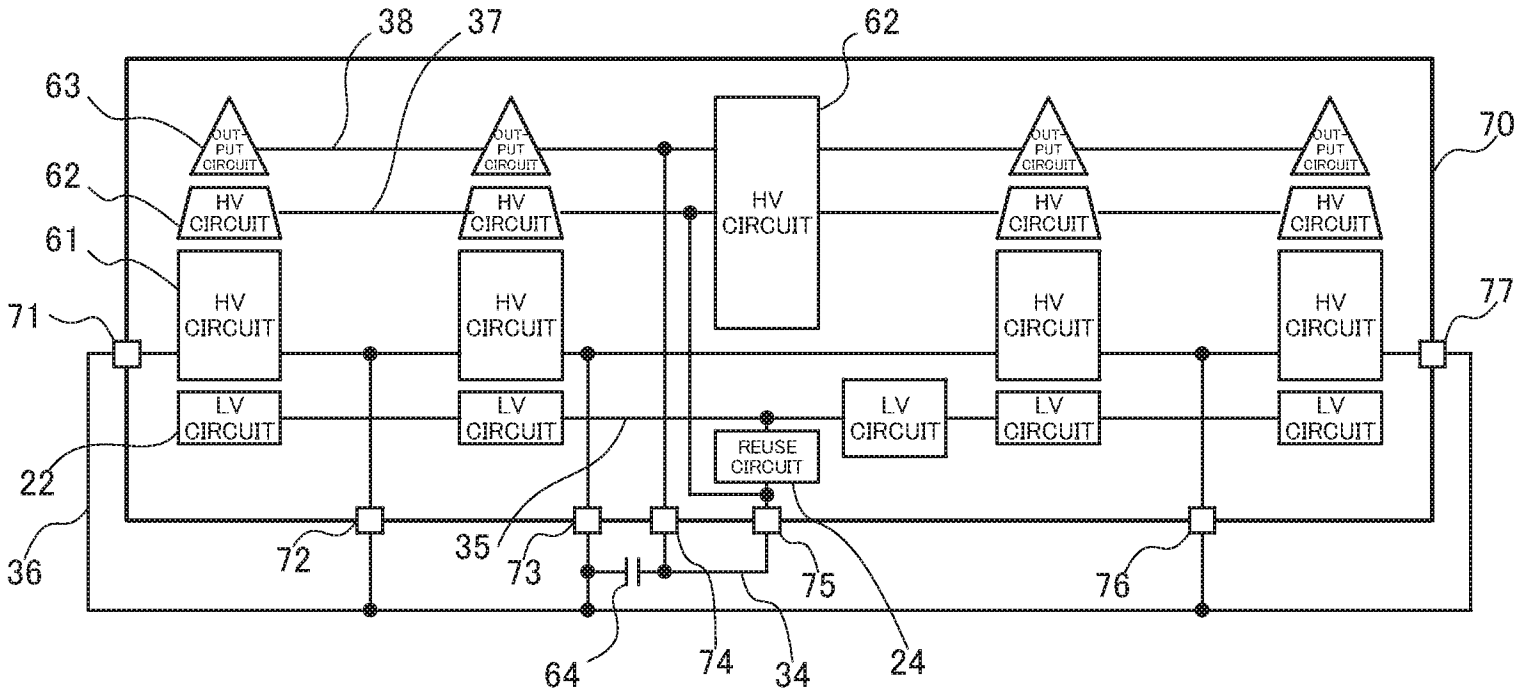
FIG. 6 is a diagram illustrating an arrangement and wiring example when circuits of the device of FIG. 5 are integrated.

FIG. 6 illustrates an arrangement and wiring example when the circuits (excluding the MV circuit) of the driving device illustrated in FIG. 5 are integrated. As illustrated in FIG. 6, each of the LV circuit 22, the HV circuits 61 and 62, and the HV output circuit 63 in an IC 70 is dispersedly arranged into a plurality of circuits. The dispersedly arranged LV circuits 22 and the reuse circuit 24 are connected to one another with the voltage application line 35. The dispersedly arranged HV circuits 61 are connected to one another with the ground line 36. The ground line 36 is also wired to the outside of the IC 70 via pads 71 to 77. The dispersedly arranged HV circuits 62 are connected to one another with a connection line 37. The dispersedly arranged HV circuits 62 are further connected to the reuse circuit 24 and the pad 75. The dispersedly arranged HV output circuits 63 are connected to one another with a connection line 38 and further to the pad 74. The pads 74 and 75 are connected to each other with the relay connection line 34. The bypass capacitor 64 is externally connected between the pads 73 and 74.

While the above-described embodiments show some examples of the driving device that drives an organic EL display panel as a display panel, the present invention is not limited thereto. The present invention can also be applied to a display driving device that drives another type of display panel and operates by the application of a plurality of supply voltages having different voltage levels.

This application is based on Japanese Application No. 2018-013271, which is incorporated herein by reference.

What is claimed is:

1. A display driving device configured to drive a display panel comprising:

a high supply voltage operation unit configured to generate an operating current under application of a high supply voltage so as to supply driving voltages to said display panel;

a low supply voltage operation unit configured to operate under application of a low supply voltage lower than said high supply voltage thereby to control said high supply voltage operation unit; and a reuse circuit configured to receive said operating current from said high supply voltage operation unit and supply said operating current to a ground side via said low supply voltage operation unit so as to apply said low supply voltage to said low supply voltage operation unit, wherein said reuse circuit includes:

a first switching element connected between a medium supply voltage line to which a medium supply voltage lower than said high supply voltage and higher than said low supply voltage is applied and a voltage application line to said low supply voltage operation unit;

a second switching element connected between an application line to which said operating current is applied from said high supply voltage operation unit and said voltage application line; and a control unit configured to supply a voltage generated on the basis of said low supply voltage to said first and second switching elements thereby to control a gate voltage.

2. The display driving device according to claim 1, wherein said reuse circuit further includes a reference voltage generation unit connected to said control unit and configured to generate a reference voltage.

3. The display driving device according to claim 1, wherein said reuse circuit further includes:

a first start-up circuit configured to temporarily apply a voltage equal to said low supply voltage to said voltage application line when it receives said medium supply voltage; and a second start-up circuit configured to temporarily apply a voltage higher than said low supply voltage and lower than said high supply voltage to said application line when it receives said medium supply voltage.

4. The display driving device according to claim 1, wherein each of said first and second switching elements includes an field-effect transistor.

* * * * *